US006402424B2

(12) United States Patent
Mitsui

(10) Patent No.: US 6,402,424 B2
(45) Date of Patent: Jun. 11, 2002

(54) VIBRATORY ROLLER

(75) Inventor: Akira Mitsui, Saitama (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/870,697

(22) Filed: Jun. 1, 2001

(30) Foreign Application Priority Data

Jun. 1, 2000 (JP) ..... 2000-164484

(51) Int. Cl.[7] ..... E01C 19/28
(52) U.S. Cl. ..... 404/117; 404/122; 404/132
(58) Field of Search ..... 404/117, 122, 404/113, 124, 127, 128, 132

(56) References Cited

U.S. PATENT DOCUMENTS 2,549,182 A * 4/1951 Ekenstam ..... 404/117
3,605,582 A * 9/1971 Kaltenegger ..... 404/117
4,201,493 A * 5/1980 Braun ..... 404/117
4,732,507 A * 3/1988 Artzberger ..... 404/117
4,927,289 A * 5/1990 Artzberger ..... 404/117
5,046,891 A * 9/1991 Vural ..... 404/117
5,984,572 A * 11/1999 Mitsui ..... 404/117

* cited by examiner

*Primary Examiner*—Robert E. Pezzuto
*Assistant Examiner*—Alexandra K. Pechhold
(74) *Attorney, Agent, or Firm*—Sughrue Mion, PLLC

(57) ABSTRACT

A vibratory roller R comprises a pair of rolls 5 axially supported at both sides of a body 1 in a cantilevered fashion, a pair of vibration generating devices 6 for vibrating each of the rolls 5, a pair of vibrating motors 7 for driving each of the vibration generating devices 6 and a pair of roll-driving motors 8 for rotating each of the rolls 5. The rolls 5 are connected to each other through the roll-driving motors 8 and by a connecting member 29, and the connecting member 29 is attached to the body 1 through vibration isolating members 30. The vibratory roller R enables a compacting operation with both rolls 5 vibrating simultaneously, and the service life of the vibration isolating members 30 can be extended.

4 Claims, 9 Drawing Sheets

VIBRATORY ROLLER

FIELD OF THE INVENTION

The present invention relates to a vibratory roller for compacting a road surface and the like.

BACKGROUND OF THE INVENTION

Compacting rollers are used for compacting an embankment of a road or a dam structure, or for compacting a road surface with asphalt paving. Generally, compacting rollers with steel wheels are classified, in terms of arrangement of the compacting wheels (hereinafter referred to as "rolls" ), into a tandem type, in which front and rear rolls are arranged in line so that one rut is positioned on top of the other between the ruts of the front and rear rolls, and a macadam type, in which three rolls are employed. Further, a-vibration generating device may be provided on the compacting roller. The compacting roller with a vibration generating device enables to compact the road surface at high densities because it can compact the road surface while vibrating the rolls. The vibration generating device is applicable to both tandem type and macadam type rollers, and the compacting roller with the vibration generating device is known as a vibratory roller.

Of these compacting rollers, a macadam-type vibratory roller is disclosed in Japanese Utility Model Publication No. HEI.3-24647. FIG. 9 schematically shows an inner structure of the roll of the conventional macadam-type vibratory roller. As shown in FIG. 9, a stationary portion 53*a* of a roll-driving motor 53, which rotates a roll 52, is fixed to a side of a body 51, and an output portion 53*b* of the roll-driving motor 53 is fixed to the roll 52 through a bracket 54 and rubber vibration isolators 55. A reference numeral 56 indicates a vibration generating device. A casing of the vibration generating device 56 is fixed to the roll 52, and the vibration generating shaft (not shown) within the casing is connected to a vibrating motor 57. A stationary portion 57*a* of the vibrating motor 57 is fixed to a bracket 58, which extends from an upper part of the body 51 toward the outer surface of the roll 52 and further into the inner region of the roll 52.

In most cases, the macadam-type vibratory roller and the tandem-type vibratory roller are distinct in its usage. The tandem-type vibratory roller is used when widely and entirely compacting a road surface, such as an asphalt pavement, and the macadam-type vibratory roller is used when compacting and connecting a joint between newly constructed road surfaces or a joint between a newly constructed road surface and an existing road surface.

In a compaction work with the use of the tandem-type vibratory roller, the following drawbacks have been pointed out.

(1) Problem Relating with Compacting Width

Normally, the tandem-type vibratory roller in 7 to 9 tons has a compacting width (or roll width) of about 1.5 to 1.7 meters. For example, when compacting one traffic lane of a roadway (viz. about 3.8 meter width), at least three compacting lanes are required. In order to reduce the number of compacting lanes, it is considered that the roll width may be increased. However, increasing the roll width would result in increased dragging of the road surface at the end of the roll positioned at the outer side of a curve, for example when compacting the curved road surface while turning the vibratory roller. This leads to deterioration in pavement quality.

Such a problem can be overcome by dividing the roll into plural parts and providing a differential mechanism or differential gears. However, this is not preferable because the construction of the vibratory roller becomes complicated and the manufacturing cost thereof also increases.

(2) Problem Relating with Contacting Characteristics

In terms of drain, the roadway is usually paved to create a slight inclination from the centerline to both road ends, as illustrated in FIG. 8. When compacting such a roadway by the tandem-type vibratory roller along the centerline, the contacting characteristics of the roll 61 becomes worse at its ends due to the width of the roll 61. This is shown in FIG. 8A. As a result, there would be an irregularity in compaction between the road surface compacted by the center part of the roll 61 and the road surface compacted by the end parts of the roll 61.

(3) Problem Relating with Roll Diameter

Generally, as the roll diameter becomes greater, the contacting characteristics against the road surface may be improved and smoother finishing of the road surface can be achieved. However, in the tandem-type vibratory roller, increasing the diameter of the roll would arise other drawbacks, such as deteriorated visibility from the driver's seat and increased size of the body.

(4) Problem Relating with Side Overhang

In the tandem-type vibratory roller, a supporting member, such as a yoke, is positioned outwardly of the end surface of the roll. For this reason, when compacting the road surface in close proximity to a wall of the structure, the operator cannot move the roll in the immediate proximity position toward the wall because of a projection amount of the supporting member (side overhang), and so non-compacting parts remain on the road surface. In this event, a further operation is required to compact the non-compacting parts, and compacting equipment such as a tamper is conventionally used for this purpose.

In order to eliminate the above drawbacks, if the macadam-type vibratory roller is used, instead of the tandem-type vibratory roller, for entirely compacting the road surface, it may be advantageous in the following reasons.

With regard to the problem (1) relating with compacting width, the macadam-type vibratory roller has a constitution such that either front or rear rolls are positioned in pair at both sides of the body, and a differential mechanism is already provided or a differential mechanism is readily mounted. Therefore, dragging of the road surface hardly occurs during the compaction on the curved road surface, even if the compacting width (viz. the total width of the three rolls except for the superposed roll width) is increased. The compacting width of the 9 to 12 ton class macadam-type vibratory roller is generally about 2.1 meters, and when compacting the aforementioned lane (about 3.8 meter width) of the roadway, only two compacting lanes are required.

With regard to the problem (2) relating with contacting characteristics, it is preferable when compacting the road surface with a slight inclination by the macadam-type vibratory roller as illustrated in FIG. 8B than when compacting by the tandem-type vibratory roller as illustrated in FIG. 8A, because the width of each roll 52 is smaller, which leads to excellent contacting characteristics against the road surface.

The finishing quality of the road surface is therefore uniform, and in other words, there are few differences in the road surface qualities due to compaction at different parts of the roll.

Further, with regard to the problem (3) relating with roll diameter, the macadam-type vibratory roller does not suffer from deteriorated visibility from the driver's seat or increased size of the body, because a pair of rolls 52 is supported at both sides of the body 51 and thus increasing the roll diameter does not affect the body 51 positioned intermediate between the rolls 52.

As mentioned above, various remarkable effects can be expected when compacting the road surface with the use of the macadam-type vibratory roller. However, when compacting the road surface widely and effectively, the whole rolls including the pair of right and left rolls 52 have to be vibrated simultaneously. In the conventional macadam-type vibratory roller, it is difficult to vibrate the right and left rolls 52 simultaneously by the following reasons.

As shown in FIG. 9, the macadam-type vibratory roller comprises a pair of rolls 52 axially supported at both sides of the body 51. Since the width of each roll 52 is considerably small in comparison with that of the roll of the tandem-type vibratory roller, on one hand, it is effective for the aforementioned problems (1) and (2). On the other hand, depending on road surface conditions, a small width roll 52 is liable to occur rocking vibration (viz. vibration rocking in right and left directions) at the roll 52 as illustrated by arrows in FIG. 9. The rocking vibration becomes greater as the ratio of the roll width to the roll diameter is small. The rocking vibration hardly occurs if the roll width is considerably large, such as in the case of the tandem-type vibratory roller. However, in the macadam-type vibratory roller where the roll width is small and the rolls 52 are supported in a cantilevered fashion to the body 51, the rocking vibration is enhanced if the center of gravity of the roll does not correspond with the center of vibration.

Accordingly, in the conventional macadam-type vibratory roller, when vibrating the pair of right and left rolls 52 simultaneously, vibration derived from the rocking vibration is transmitted from both sides of the body 51 regardless of the provision of rubber vibration isolators 55. As a result, such a heavy vibration is transmitted to the driver's seat that the operator cannot sit on the seat, and also irregularly paved parts are made on the road surface when compacting with the macadam-type vibratory roller. For this reason, the conventional macadam-type vibratory roller is mainly used for compacting the road surface in a particular and localized area, such as compacting and connecting a joint on the road surface, with one of the right and left rolls 52 vibrating.

In the conventional macadam-type vibratory roller, there is also a drawback that the deflection side of the rubber vibration isolator 55 varies because the isolator 55 rotates together with the roll 52, and thereby suspended load becomes alternate load.

Further, likewise the tandem-type vibratory roller, the conventional macadam-type vibratory roller has a problem (4) relating with side overhang. In other words, as shown in FIG. 9, because the bracket 58 projects outward from the roll 52, the operator cannot move the roll 52 in the immediate proximity position toward the wall of the structure, and non-compacting parts remain on the road surface.

With the foregoing drawbacks of the prior art in view, the subject of the present invention is to provide a vibratory roller having a pair of rolls supported in a cantilevered fashion to the body, which vibratory roller allows a compaction work with both rolls vibrating simultaneously.

SUMMARY OF THE INVENTION

According to a first aspect of the invention, there is provided a vibratory roller comprising: a pair of rolls axially supported at both sides of a body in a cantilevered fashion; a pair of vibration generating devices for vibrating each of the rolls; a pair of vibrating motors for driving each of the vibration generating devices; and a pair of roll-driving motors for rotating each of the rolls, wherein the rolls are connected to each other through the roll-driving motors and by a connecting member, and the connecting member is attached to the body through vibration isolating members.

With such a constitution, because the rolls are connected to each other through the roll-driving motors and by the connecting member, and further the connecting member is attached to the body through vibration isolating members, occurrence of the rocking vibration is prevented and the compacting operation can be carried out with both right and left rolls vibrating simultaneously. Therefore, if the rear roll vibrates i n addition to the front pair of rolls, an effective and high density compaction can be achieved in a wide range road surface.

According to a second aspect of the invention, the vibration isolating members are arranged outside of the body.

With such a constitution, because the vibration isolating members are arranged outside of the body, sufficient free layout space for the driving engine or the hydraulic piping can be made.

According to a third aspect of the invention, each of the roll-driving motors is a hollow construction-type motor with a through opening, and the roll-driving motor is positioned between the vibrating motor adjacent to the body and the vibration generating device adjacent to the roll. And a driving member for driving the vibration generating device is inserted through the through opening and is connected to the vibrating motor.

With such a constitution, because the side overhang is overcome, the operator can move the roll in the immediate proximity position toward the wall of the structure. Therefore, the compacting operation is carried out effectively and uniform finishing quality of the paved road surface is achieved.

BRIEF DESCRIPTION OF THE DRAWINGS

Preferred embodiments of the present invention will be described below, by way of example only, with reference to the accompanying drawings, in which.

DESCRIPTION OF THE PREFERRED EMBODIMENT

With reference to the attached drawings, preferred embodiments of a vibratory roller according to the present invention will be described. Although the vibratory roller is referred to as a macadam-type vibratory roller, the present invention is not limited to this particular type. The present invention may be applied to any vibratory roller, as long as the vibratory roller comprises a pair of rolls axially supported at both sides of a body in a cantilevered fashion, a pair of vibration generating devices for vibrating each of the rolls, a pair of vibrating motors for driving each of the vibration generating devices and a pair of roll-driving motors for rotating each of the rolls.

Figure 1A:
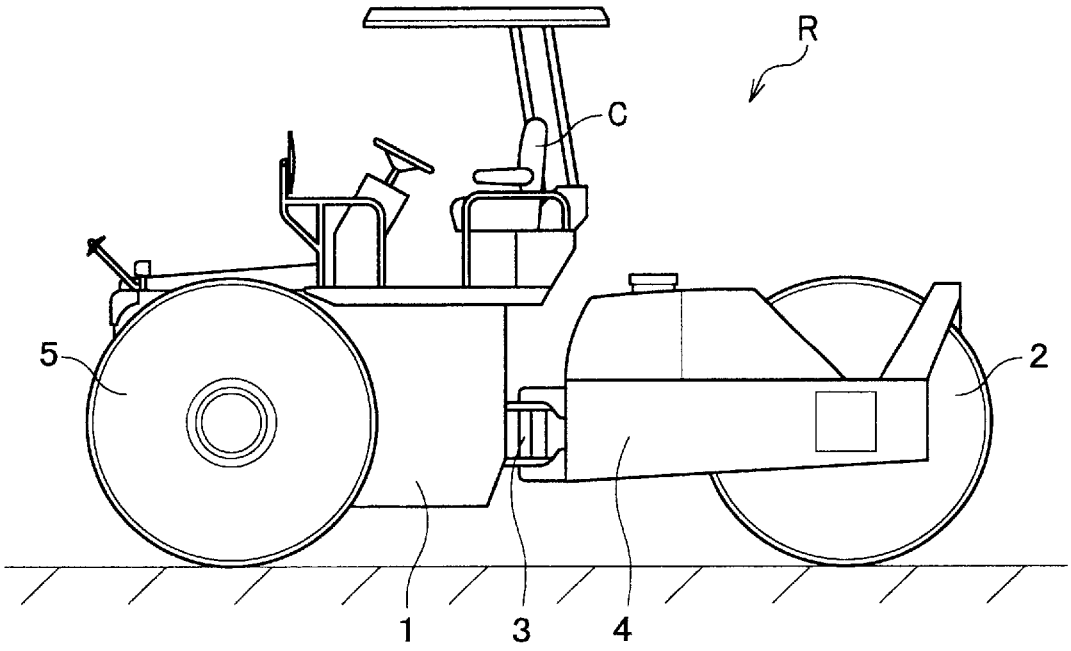
FIG. 1A is a side view showing a macadam-type vibratory roller according to the present invention.
Figure 1B:
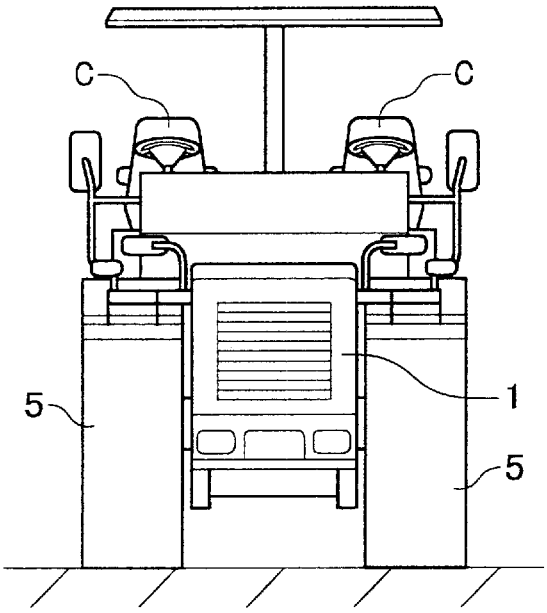
FIG. 1B is a front view of the same.

As shown in FIG. 1, the macadam-type vibratory roller R is equipped with two front rolls and one rear roll, and driver's seats C are provided on a body 1. The illustrated vibratory roller is a so-called articulated frame steering type, in which a U-shaped yoke 4, viewing from the top, supports the rear roll 2 axially at both sides of the roll 2, and the yoke 4 is connected to the body 1 through a center pin 3. The vibratory roller R is operated by hydraulic cylinders (not shown) in such a way that the body 1 and the yoke 4 are rotated to each other around the center pin 3 as a fulcrum.

Figure 2:
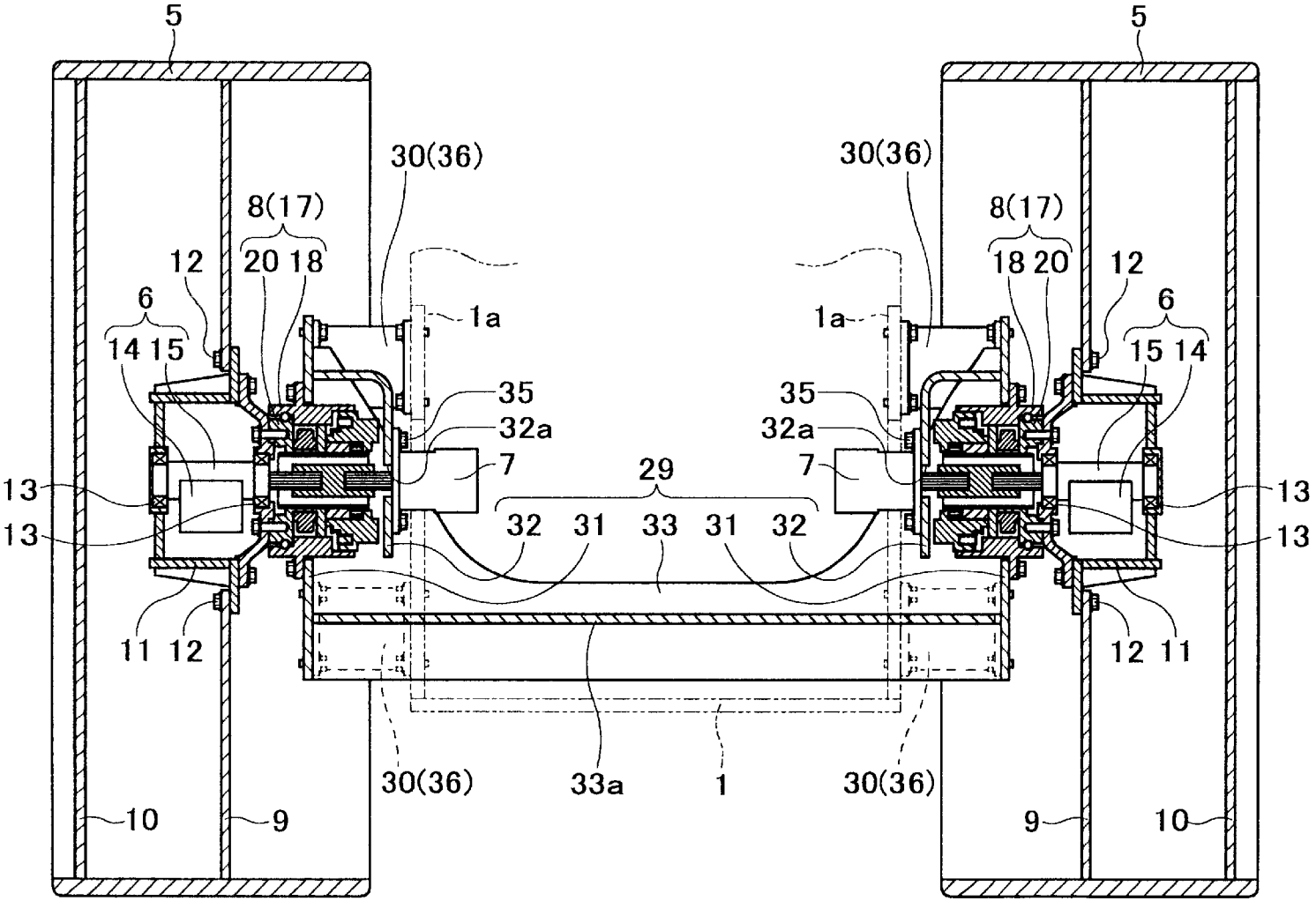
FIG. 2 is a front explanatory view showing the subject of the invention.
Figure 3:
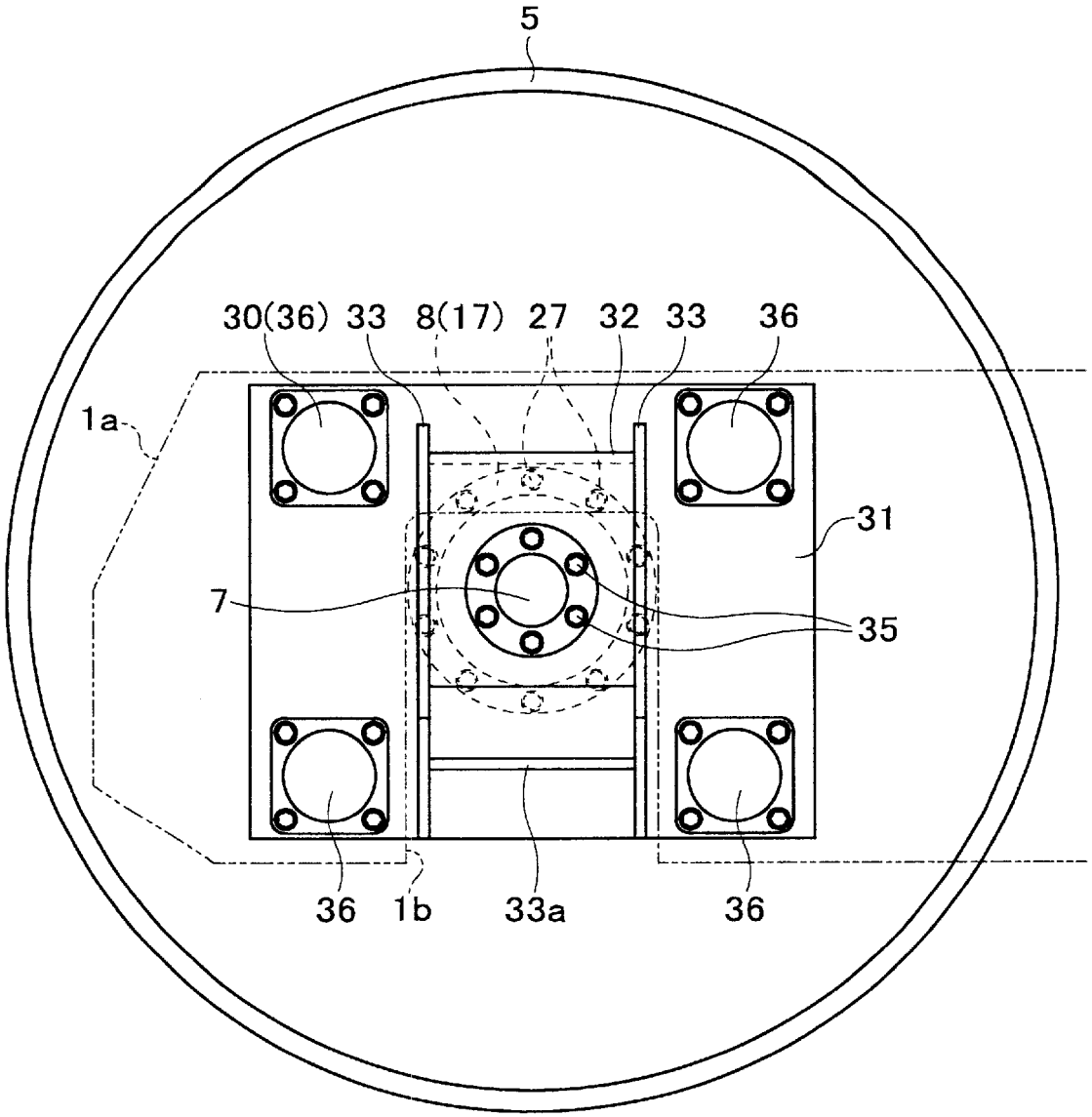
FIG. 3 is a side explanatory view showing the subject of the invention.

Front rolls 5 are provided in pair, and the pair of rolls 5 is axially supported at both sides of the body 1 in a cantilevered fashion. As shown in FIG. 2, each roll 5 accommodates a vibration generating device 6. A vibrating motor 7 for driving the vibration generating device 6 and a roll-driving motor 8 for rotating the roll 5 are provided for each roll 5. In this preferred embodiment, hydraulic motors are employed as the vibrating motor 7 and the roll-driving motor 8. The rear roll 2 also accommodates a vibration generating device. However, since the roll 2 is axially supported by the yoke 4 at both sides of the roll 2 and the roll 2 is mounted to the yoke 4 by a known mounting structure, the explanation thereof will be omitted in the following description.

With reference to FIG. 2, the vibration generating device 6, the vibrating motor 7 and the roll-driving motor 8 are positioned, from the body 1, in the order of the vibrating motor 7, the roll-driving motor 8 and the vibration generating device 6. In other words, with the roll-driving motor 8 positioned intermediately, the vibrating motor 7 is positioned close to the body 1 and the vibration generating device 6 is positioned close to the roll 5 (at an outer side of the roll 5).

A disk-shaped first and second end plates 9 and 10 are separately fixed to the inner periphery of the roll 5. The vibration generating device 6 is positioned between the first end plate 9 and the second end plate 10 and concentrically with the roll 5. As an example of the assembly, such as illustrated in FIG. 2, a through opening is formed at a center portion of the first end plate 9, and the casing 11 accommodating the vibration generating device 6 is received in the through opening and thereafter fixed at the fringe part of the through opening by bolts 12. The vibration generating device 6 according to this preferred embodiment is a one shaft eccentric drive type, viz. a vibration generating shaft 15, which together with an eccentric weight 14 fixed thereto forms the vibration generating device 6, is rotatably supported within the casing 11 through bearings 13 and is concentric with the roll 5.

Figure 5A:
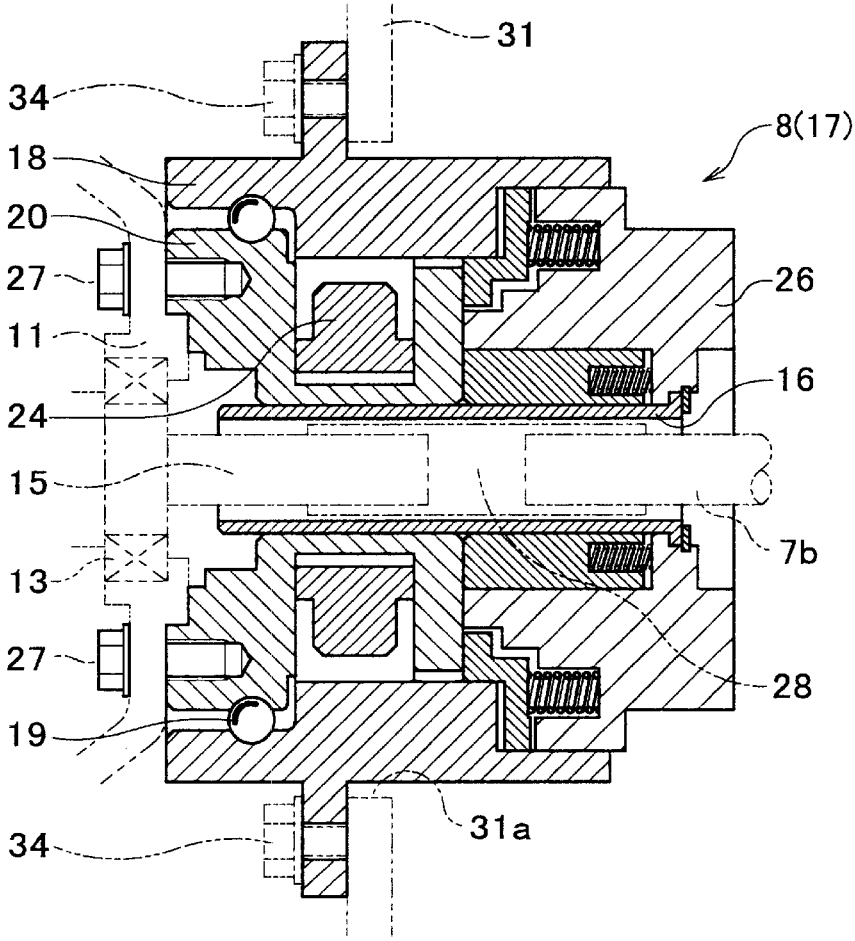
FIG. 5A is a side sectional view showing the structure of a roll-driving motor.
Figure 5B:
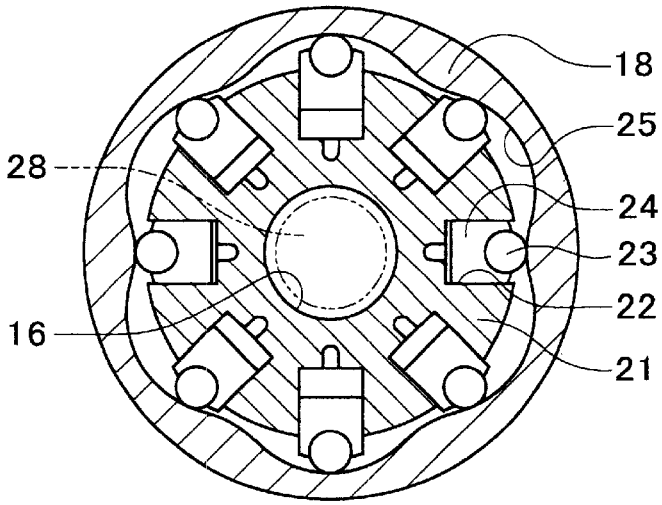
FIG. 5B is a front sectional view of the roll-driving motor showing pistons.

As the roll-driving motor 8, the vibratory roller R according to this preferred embodiment employs a hollow and non-shaft type motor having a through opening 16 (FIG. 5A), and specifically a multi-process type radial piston motor 17 is used. The radial piston motor 17 is a known hydraulic motor, which is thin and is capable of generating a high torque at low speeds, and as shown in FIG. 5A, an output portion 20 is rotatably supported within a stationary portion 18 forming a case through a bearing 19. As shown in FIG. 5B, a thin cylinder block 21 with a circular section is fixed to the output portion 20. Provided at the outer periphery of the cylinder block 21 are peripherally equispaced plurality of cylinders 22, and a piston 24 provided at its front end with a roller 23 is inserted into each of the cylinders 22 so as to be movable in a radial direction of the cylinder block 21. A cam surface 25 is formed on the inner surface of the stationary portion 18, where the rollers 23 contact. A reference numeral 26 in FIG. 5A indicates a disc brake.

Accordingly, when pressure oil flows into each cylinder 22 through a pressure oil port, the piston 24 moves within the cylinder 22 and the roller 23 pushes the cam surface 25 so that the output portion 20 rotates by the reaction force from the cam surface 25. The multi-process type radial piston motor 17 is constructed as above, and the output portion 20 can be formed as a non-shaft configuration. Therefore, since the output portion 20, viewing sectionally from the front side, can be formed as a ring shaped member, the through opening 16 can be provided at the center of the output portion 20.

In the radial piston motor 17, the empty core of the through opening 16 is positioned concentrically with the rotary shaft core of the roll 5, and the output portion 20 is fixed to the casing 11 of the vibration generating device by bolts 27. One end of the vibration generating shaft 15 of the vibration generating device 6 projects from the casing 11 and is inserted into the through opening 16 of the radial piston motor 17, and it is connected to the output shaft 7*b* of the vibrating motor 7 through a coupling 28.

Figure 4:
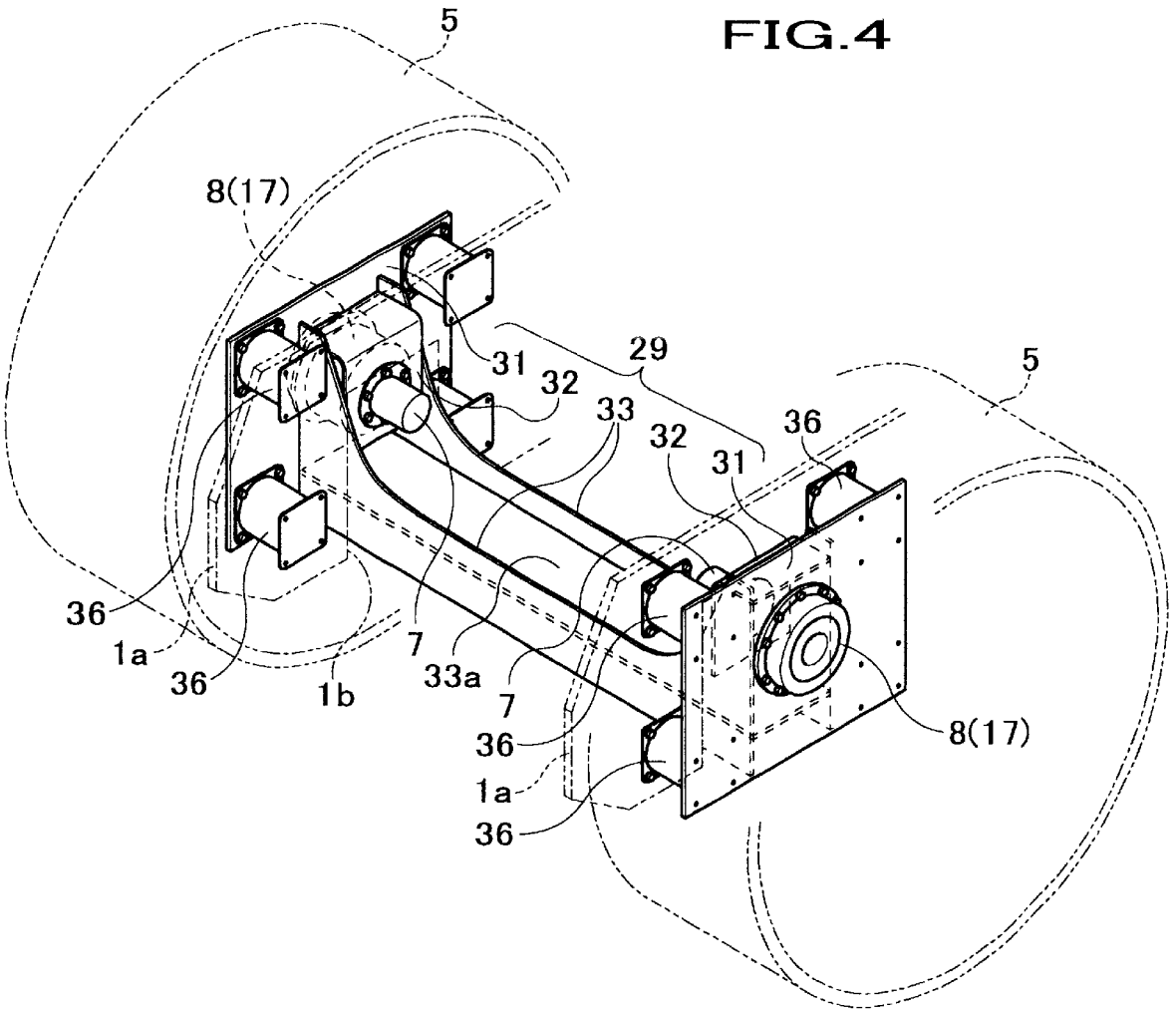
FIG. 4 is a perspective view showing the subject of the invention.

The main feature of the present invention is that the right and left rolls 5 are connected to each other through the roll-driving motors 8 and by a connecting member 29, and that the connecting member 29 is attached to the body 1 through vibration isolating members 30. As shown in FIGS. 2 and 4, the connecting member 29 according to this preferred embodiment comprises a pair of right and left mounting plates 31 formed by a rectangular-shaped plate member, a pair of right and left brackets 32 bent in a form of the letter L, and a pair of front and rear connecting plates 33 extending in rightward and leftward directions. The mounting plate 31 is arranged, at the outer side of the body 1, parallel to the side plate 1*a* of the body 1. At one side of the mounting plate 31 opposing to the body 1, the bracket 32 is fixed for example by welding so that one surface of the bracket 32 is apart from and parallel to the mounting plate 31. The front and rear connecting plates 33 are fixed perpendicularly at one end to the mounting plate 31 for example by welding in such a way that the bracket 32 is sandwiched between the pair of connecting plates 33. Both side plates 1*a* of the body 1 form a cutting 1*b* for the insertion of the connecting plates 33, and the pair of connecting plates 33 extends in rightward and leftward directions through the cuttings 1*b* and within the body 1. A reinforcement plate 33*a* is fixed to the front and rear connecting plates 33 so as to bridge between the connecting plates 33.

As shown in FIG. 5A, an opening 31*a* is formed at a center of the mounting plate 31 for the insertion of the radial piston motor 17. The radial piston motor 17 is inserted into the opening 31a and the stationary portion 18 thereof is fixed to the mounting plate 31 by bolts 34. As shown in FIG. 2, an opening 32*a* is formed in the bracket 32, and the output shaft 7*a* of the vibrating motor 7 is inserted through the opening 32*a* and into the through opening 16 of the radial piston motor 17. As mentioned above, the output shaft 7*a* of the vibrating motor 7 is connected to the vibration generating shaft 15 by the coupling 28. The casing of the vibrating motor 7 is fixed to the bracket 32 by bolts 35.

As mentioned above, the right and left rolls 5 accommodating the vibration generating device 6 are connected to each other through the roll-driving motors 8 and by the connecting member 29. As long as having a certain rigidity, the connecting member 29 is not limited to a particular shape or the like. The connecting member 29 is attached to the body 1 through vibration isolating members 30. According to this embodiment, four corner portions of the mounting plate 31 are attached to the side plate 1*a* of the body 1 through cylinder-shaped rubber vibration isolators 36. Each of the rubber vibration isolators 36 is fixed to the mounting plate 31 and the side plate la by bolts or the like.

Operation of the vibratory roller according to the present invention will be described. As mentioned above, in the roll-driving motor 8 (viz. radial piston motor 17), when hydraulic oil flows into each cylinder 22, the output portion 20 rotates with respect to the stationary portion 18. With the rotation of the output portion 20, the roll 5 fixed thereto also rotates and compacts the road surface. When the vibrating motor 7 is supplied with hydraulic oil, the vibration generating shaft 15 and hence the eccentric weight 14 is rotated via the coupling 28. As the result of the rotation of the eccentric weight 14, vibration generating force is generated and the roll 5 vibrates.

Figure 9:
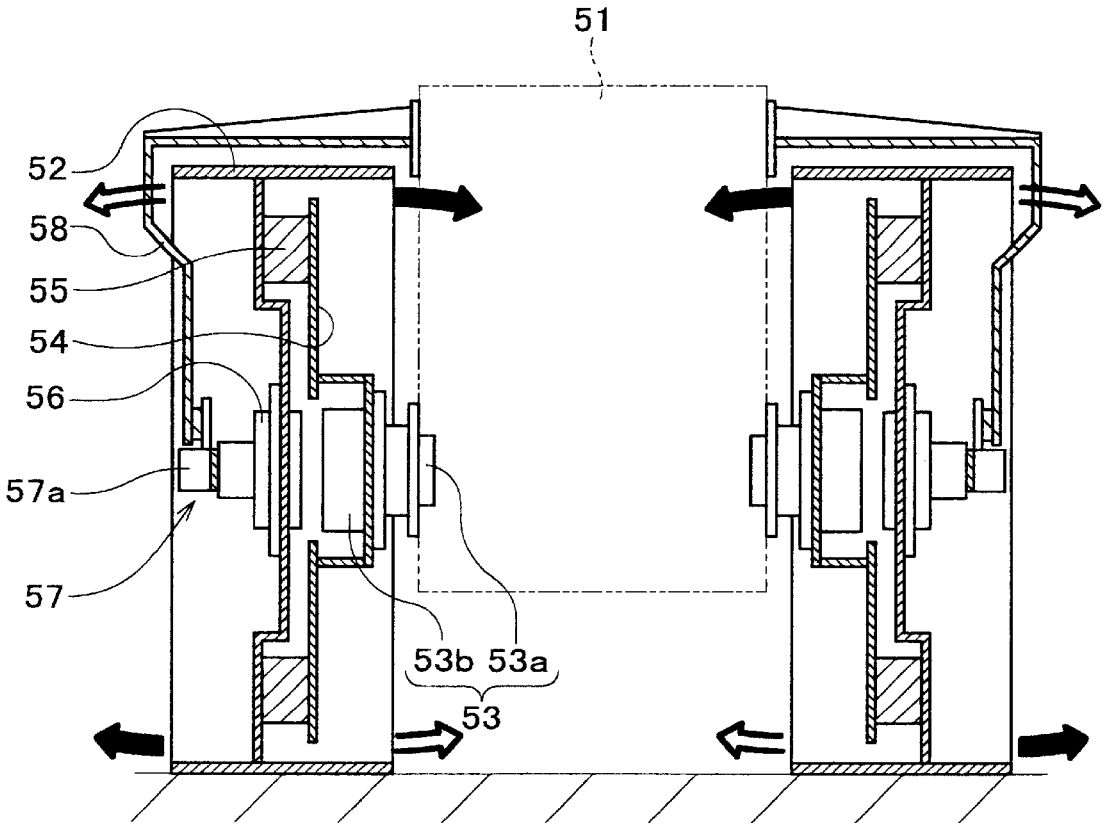
FIG.9 PRIOR ART
FIG. 9 is an explanatory view schematically illustrates the inner structure of a roll of a conventional macadam-type vibratory roller.

Since the right and left rolls 5 are connected by the connecting member 29 with a certain rigidity and the rolls 5 can be considered as a uniform and single wide roll with its intermediate portion cut off, the rocking vibration, such as shown in FIG. 9, hardly occurs even when the right and left rolls 5 vibrates simultaneously. Therefore, a great vibrating force due to the rocking vibration is not transmitted to the body 1, and a relatively small vibration that is as small as the compaction by the conventional tandem-type vibratory roller is transmitted to the operator seated on the driver's seat C. Also, it is possible to finish the road surface smoothly. According to the present invention, it is possible to compact the road surface while both right and left rolls 5 vibrating, and when the rear roll 2 additionally vibrates, the entire and wide range compacting operation of the road surface, which has been carried out by the conventional tandem-type vibratory roller, can be made in addition to the compacting operation at a joint.

Further, since the vibration isolating members 30 (viz. rubber vibration isolators 36) are non-rotatably fixed to the body 1, it is possible to eliminate the drawbacks of the prior art that the deflection side of the rubber vibration isolator varies because the isolator rotates together with the roll, and that suspended load becomes alternate load. As a result, the strength required for the vibration isolating members 30 is decreased, and otherwise the service life of the vibration isolating members 30 is extended.

The ON-OFF operation of the right and left rolls 5 and the roll 2 is carried out by the switch (not shown), such as a rotary switch capable of switching to the respective vibration modes, provided around the driver's seat C. For example, the vibration modes include: (1) a mode only vibrating the right roll 5; and (2) a mode only vibrating the left roll 5; for the local compacting operation, such as a joint, and (3) a mode vibrating all the rolls including the right and left rolls 5 and the rear roll 2; for the entire and wide range compacting operation of the road surface. Further vibration modes, such as a mode only vibrating the right and left rolls 5 and a mode only vibrating the rear roll 2 may be adapted when necessary.

In comparison with the conventional tandem-type vibratory roller, merits and advantages of the macadam-type vibratory roller R, to which the present invention is applied, will be given as follows.

(1) When compacting the curved road surface while turning the vibratory roller, dragging of the road surface hardly occurs and a flat and smooth compacting of the road surface can be achieved, because the right and left rolls 5 move differentially to compact the road surface.

(2) When compacting a road surface where a slight inclination is made perpendicularly to the compacting direction from the centerline to both road ends, uniform finishing quality of the road surface can be achieved, because each roll 5 or the roll 2 can contact the road surface in accordance with the inclination angle.

(3) Because of the increasing compacting width, the number of compacting lanes is reduced and the working efficiency of the compacting operation can be increased.

(4) The diameter of the roll 5 can be increased without increasing the size of the body 1, viz. without deterioration of the visibility from the driver's seat C and the manufacturing cost, and excellent finishing of the road surface can be achieved.

Figure 6:
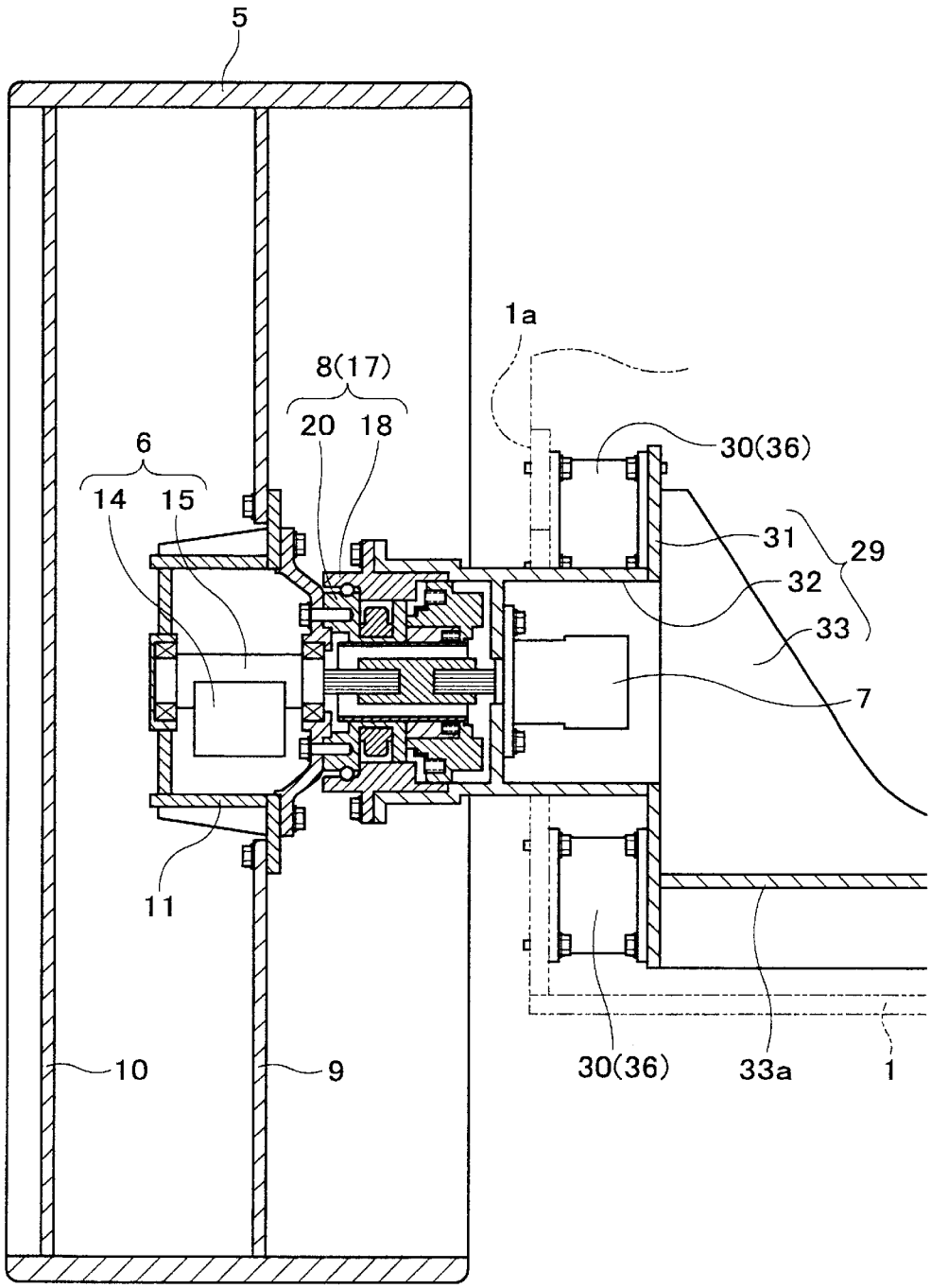
FIG. 6 is a front explanatory view illustrating a first modified embodiment of the present invention.

Further, if the vibration isolating members 30 are positioned outside of the body 1, the following advantage is achieved. As shown in FIG. 6, a first modified embodiment of the present invention comprises vibration isolating members 30 (or rubber vibration isolators 36) positioned inside of the body 1. Herein, the shape of the connecting member 29 is slightly modified. Such an arrangement is adaptable to the vibratory roller when there is a sufficient inner space within the body 1. However, usually the engine for driving the vehicle, hydraulic piping and other parts are compactly positioned within the body 1. Therefore, if the vibration isolating members 30 are positioned inside of the body 1, the shape and the layout design of the mounting devices, such as the vibration isolating member 30 per se and the engine, would suffer from great limitations. Providing the vibration isolating members 30 outside of the body 1 can eliminate this problem, and the existing types of vibratory rollers can be readily adapted to the vibratory roller according the present invention.

In this embodiment, the connecting member 29 positions at a lower of the body 1 and extends through the body 1. However, if hydraulic piping or other parts occupies this space, the connecting member 29 may extend below the body 1 without passing through the body 1.

Further, the vibratory roller R employs a constitution such that the roll-driving motor 8 is a hollow construction-type motor with a through opening 16, and the roll-driving motor 8 is positioned between the vibrating motor 7 adjacent to the body 1 and the vibration generating device 6 adjacent to the roll 5, and that the driving member for driving the vibration generating device 6 (for example, the vibration generating shaft 15 per se, the coupling 28, and the output shaft 7*a* of the vibrating motor 7) is inserted through the through opening 16 and is connected to the vibrating motor 7 (hereinafter referred to as "constitution A" ). With such a constitution the following effects can be achieved.

Figure 7:
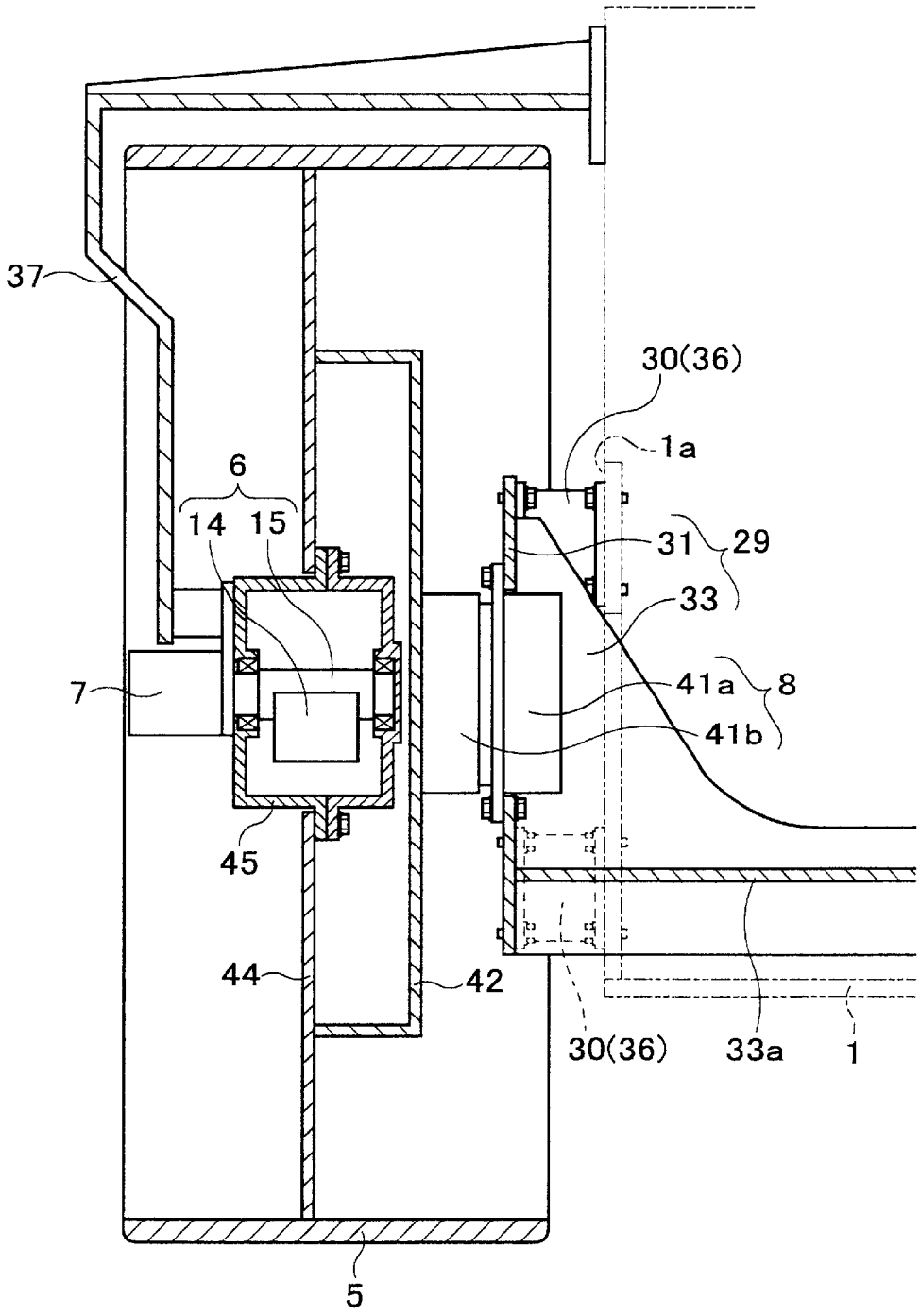
FIG. 7 is a front explanatory view illustrating a second modified embodiment of the-present invention.
Figure 8A:
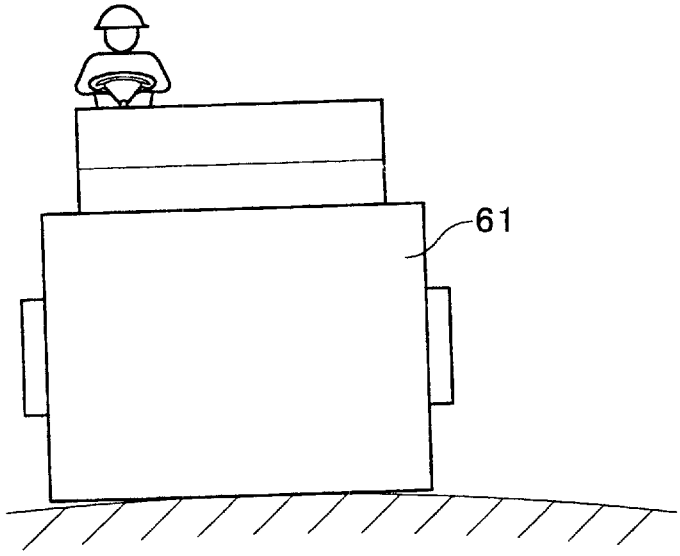
FIG.8A PRIOR ART
FIG. 8A is a front explanatory view explaining a compacting operation with a tandem-type vibratory roller on a road surface having a slight inclination from the centerline to both road ends.
Figure 8B:
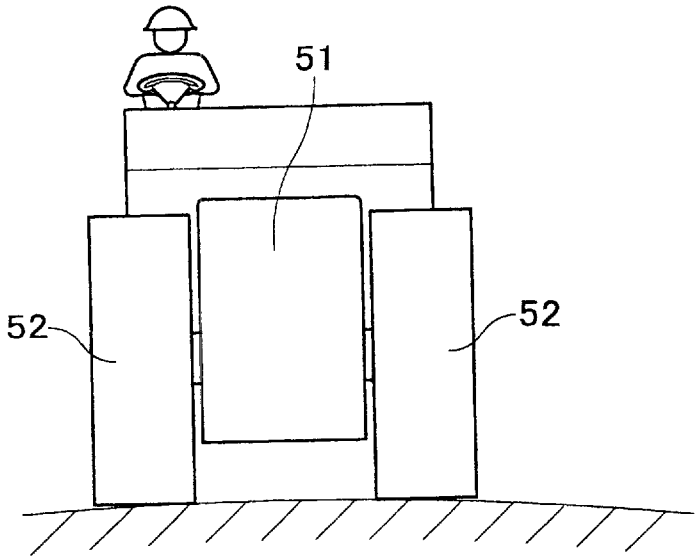
FIG.8B PRIOR ART
FIG. 8B is a front explanatory view explaining a compacting operation with a macadam-type vibratory roller on a road surface similar to FIG. 8A.

For the purpose of comparison, a second modified embodiment of the present invention will be described. As shown in FIG. 7 and as disclosed in the above Japanese Utility Model Publication No. HEI.3-24647, the vibrating motor 7 positions at the outer end of the roll 5. The output portion 41*b* of the roll-driving motor 8 is mounted through the bracket 42 to the end plate 44, which is fixed along the inner periphery of the roll 5. The stationary portion 41*a* is mounted to the connecting member 29 made by the mounting plate 31 and the connecting plate 33. And the connecting member 29 is connected at the mounting plate 31 to the side plate 1*a* of the body 1 through the rubber vibration isolators 36. The casing 45 accommodating the vibration generating device 6 is attached to the end plate 44, and the vibration generating shaft 15 is connected to the vibrating motor 7.

In this constitution, since the case of the vibrating motor 7 has to be mounted non-rotatably to the body 1, it is necessary to employ the bracket 37 for detouring the outer side surface of the roll 5. In this event, as mentioned above, the operator cannot move the roll 5 in the immediate proximity position toward the wall of the structure because of the projection amount of the bracket 37 (side overhang). On the contrary, the constitution A does not require the bracket which projects from the outer surface of the roll 5. Therefore, the compacting operation while moving the roll 5 in the immediate proximity position toward the wall can be carried out, leading to improved working efficiency of the compacting operation and uniform pavement quality.

Further, in the constitution A, the vibrating motor 7 positions within the body 1, and only the vibration generating device 6 and the roll-driving motor 8 are arranged within the roll 5. For this reason, the occupying space of the vibration generating 25 device 6 (viz. the casing 11 of the vibration generating device and the like) may be increased in the lateral direction of the roll 5. Therefore, a large-sized vibration generating device can be used, and the vibration generating device may be two shaft-type with gear transmission. Accordingly, a wide range design of the vibration generating device 6 is available in the limited inner space of the roll 5, and various vibration generating devices may be designed for various demands.

Further, when a multi-process type radial piston motor 17 is used as the roll-driving motor 8, the following advantages are achieved. As mentioned above, the radial piston motor 17 is thin and is capable of generating a high torque at low speeds. Because the motor 17 generates a high torque at low speeds, reduction gears are not required when applying the motor 17 to the roll 5, and therefore the occupying space of the roll-driving motor 8 may be reduced in the lateral direction of the roll 5. In the combination of the arrangement where the vibrating motor 7 is positioned within the body 1, such a constitution allows more extended occupying space of the vibration generating device 6 in the lateral direction of the roll 5 and more layout designs of the vibration generating device 6 in the end.

While the invention has been described in detail and with reference to specific embodiments thereof including modifications, it will be apparent to one skilled in the art that various changes and modifications in shape or layout of each element can be made therein without departing from the spirit and scope thereof.

What is claimed is:

1. A vibratory roller comprising:

a pair of rolls axially supported at both sides of a body in a cantilevered fashion;

a pair of vibration generating devices for vibrating each of said rolls;

a pair of vibrating motors for driving each of said vibration generating devices; and a pair of roll-driving motors for rotating each of said rolls, wherein said rolls are connected to each other through the roll-driving motors and by a connecting member, and said connecting member is attached to the body through vibration isolating members.

2. A vibratory roller according to claim 1, wherein said vibration isolating members are arranged outside of the body.

3. A vibratory roller according to claim 1, wherein each of said roll-driving motors is a hollow construction-type motor with a through opening, and said roll-driving motor is positioned between the vibrating motor adjacent to the body and the vibration generating device adjacent to the roll, and wherein a driving member for driving said vibration generating device is inserted through the through opening and is connected to said vibrating motor.

4. A vibratory roller according to claim 2, wherein each of said roll-driving motors is a hollow construction-type motor with a through opening, and said roll-driving motor is positioned between the vibrating motor adjacent to the body and the vibration generating device adjacent to the roll, and wherein a driving member for driving said vibration generating device is inserted through the through opening and is connected to said vibrating motor.

* * * * *